United States Patent [19]

Biederstedt et al.

[11] Patent Number: 5,000,703

[45] Date of Patent: Mar. 19, 1991

[54] CONNECTOR BANK

[75] Inventors: Lutz Biederstedt; Manfred Müller, both of Berlin, Fed. Rep. of Germany

[73] Assignee: Krone Aktiengesellschaft, Berlin, Fed. Rep. of Germany

[21] Appl. No.: 469,948

[22] Filed: Jan. 25, 1990

[30] Foreign Application Priority Data

Jan. 26, 1989 [DE] Fed. Rep. of Germany ..... 3902575

[51] Int. Cl.[5] ..... H01R 9/22

[52] U.S. Cl. ..... 439/709; 439/92

[58] Field of Search ..... 439/709, 712, 715, 718, 439/719, 723, 724, 404, 92, 610, 907

[56] References Cited

U.S. PATENT DOCUMENTS 4,688,865 8/1987 Kelly ..... 439/709

4,767,354 8/1988 Saligny ..... 439/724

4,851,967 7/1989 Gerke et al. ..... 439/723 X 4,871,330 10/1989 Muller et al. ..... 439/709

4,907,263 3/1990 Neuwirth ..... 439/92 X

*Primary Examiner*—Neil Abrams

*Assistant Examiner*—Khiem Nguyen

*Attorney, Agent, or Firm*—McGlew & Tuttle

[57] ABSTRACT

The invention relates to a connector bank for conductors, in particular of telecommunication and data systems, comprising a bank body 6 with at least one line of insulation displacement contacts 4 provided with contact slots 5 for the conductors 7.

According to the invention, there is provided for connecting shielded cables 22 a shield connecting element 1 consisting of a U-shaped, bent sheet piece 2, the legs 3 of which are insertable into the contact slots 5 of two insulation displacement contact elements 4 and the base 17 of which is provided with a shield connecting contact 19 for connecting the shield cable 21 of the cables 22, the spacing of the legs 3 corresponding at least to twice the spacing of two adjacent insulation displacement contact elements 4.

11 Claims, 2 Drawing Sheets

CONNECTOR BANK

FIELD AND BACKGROUND OF THE INVENTION

The invention relates to a connector bank for use in telecommunication and data systems for connecting a shielded cable including a shield cable. The bank includes a bank body with at least one line of insulation displacement contacts, (cutting/clamping contacts) provided with contact slots for engaging conductor elements of the cable.

A connector bank of this type is known in the art from West German Patent 28 04 478. In such a connector bank, serving in particular for telephone cables, insulation displacement contacts are arranged in the bank body. It is disadvantageous that it is not possible with this arrangement to connect shielded cables. The arrangement does not provide a terminal position for a shield connection. Another disadvantage consists in that the insulation displacement contacts are not protected sufficiently against voltage surges acting from outside.

SUMMARY AND OBJECTS OF THE INVENTION

It is an object of the invention to provide a shield connection for a standard connector bank. The shield connection is provided to be subsequently mounted at the bank body. The shield connection serves for connecting a shielded cable and also protects the insulation displacement contacts disposed in the connector bank sufficiently against voltage surges.

According to the invention, a shield connecting element is formed of a sheet piece and bent to form at least one U-shaped portion including legs which are insertable into the contact slots and engagable width associated cutting/clamping contacts. The shield connecting element includes a base portion with a shield connecting contact for connecting the shield cable of the shielded cable. The legs of the shield connecting contact are spaced a distance corresponding at least to twice the distance of two adjacent insulation displacement contact elements or greater than twice the spacing of two adjacent contact slots.

By plugging on the shield connecting elements according to the invention, a common connector bank can later be provided with shield terminals. These shield connecting elements are formed and manufactured in a simple manner as U-shaped sheet pieces. The sheet pieces serve both as shield connecting elements and protect the insulation displacement contacts disposed in the connector bank against voltage surges.

According to a second embodiment of the invention, the shield connecting element is formed from a rectangular sheet piece and allows the shielding of conductors connected to the incoming and outgoing side of the bank.

According to another feature of the invention, the legs of the sheet piece comprise two inwardly bent support ribs positioned to rest against the outer sides of the clamping piece or on the other side of the bank body. This allows a plug connector inserted into the connector bank to contact the shield connecting element.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
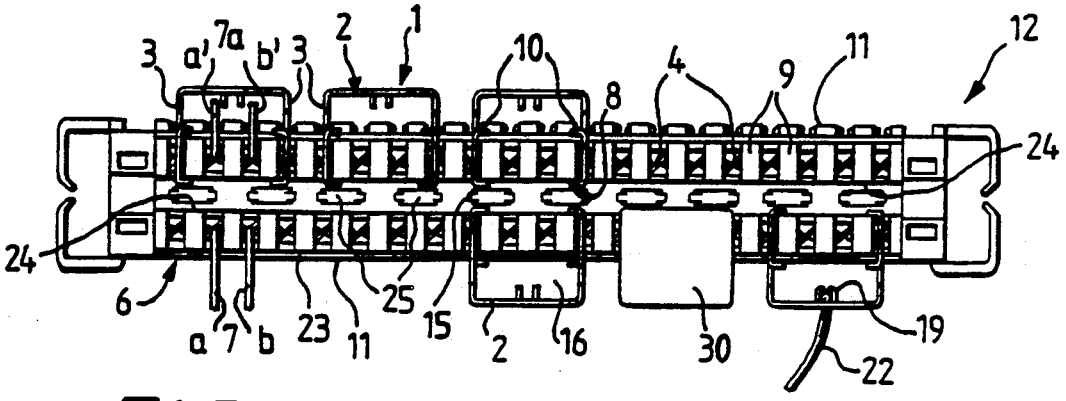
FIG. 1 is a top view of a connector bank with several shield connecting elements of a first embodiment of the invention.

Referring to FIGS. 1 to 4 in particular, the first embodiment of the invention comprises a connector bank 12 and several shield connecting elements 1. The connector bank 12 includes a bank body 6 with an upper part 13 and a lower part 14. The upper and lower parts 13 and 14 are made from plastic and are latch connected to each other. Two parallel lines of clamping slots 27 are provided between two clamping pieces 9 of the connector bank 12. Metal contact elements 4 are arranged in the slots 27. According to the first embodiment wherein the connector bank 12 includes a disconnector bank arrangement, two opposed contact elements 4 are provided connected to each other over a disconnecting contact 26 having a disconnect position 15. The contact elements 4 are formed from insulation displacement contacts (i.e. cutting/clamping contacts) and serve for connecting insulated conductors 7. A connector bank of this kind is described in detail in DE-PS 28 04 478, to which explicit reference is made.

Figure 4:
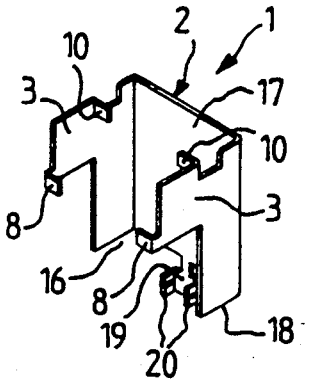
FIG. 4 is a perspective view of the shield connecting element according to FIG. 1.

The shield connecting element 1 comprises, as shown in FIG. 4, a sheet piece 2 (such as sheet metal or the like provided with two rectangularly bent-off legs 3 extending in the same direction from a base 2. This arrangement forms a U-shaped sheet piece 2. Support ribs 8, 10 are bent off each leg 3 toward the inner side 16 of the U-shaped sheet piece 2. The support ribs 8 and 10 are displaced in height relative to each other, such that a stable position of the shield connecting element 1 is achieved with respect to tilting after mounting on the connector bank 12, as will be described later in detail. At the lower edge 18 of the base 17 of the shield connecting element 1 there is provided a shield connecting contact 19 for clamping fast a shield 21 of a shield cable 22. The shield connecting contact consists substantially of two sheet-metal lugs 20 bent-off in the same direction. The sheet-metal lugs 20 are bent around the shield 21 after inserting the shield 21 or the shield web, resp., until the shield is in electrical and mechanical contact with the shield connecting element 1. The shield connecting element may be provided with a cover 30 serving for protection of the connected conductor 7.

As a contact position for a plug connector (not shown) for carrying-on the potential of the shield connecting element 1, a contact tongue 29 is formed on at the upper edge 28 of the shield connecting element.

Figure 2:
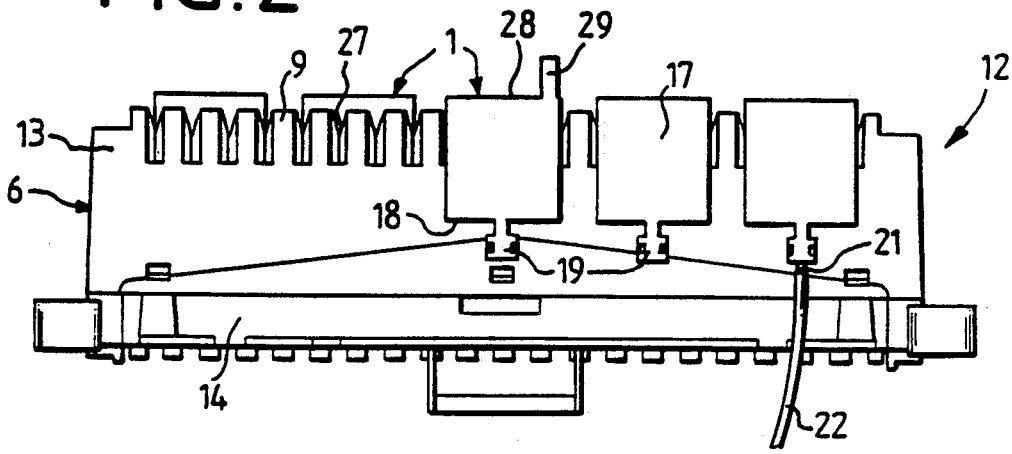
FIG. 2 is a side view of the connector bank according to FIG. 1.
Figure 3:
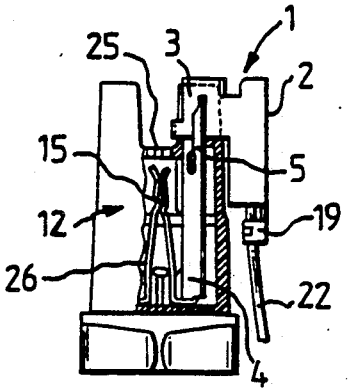
FIG. 3 is a cross-sectional view through the connector bank of FIG. 1.

The shield connecting elements 1 are mounted from above on the connector bank 12, as shown in FIGS. 1 to 3.

On a 10-d.w. (double wire) connector bank 12, in total five shield connecting elements 1 can each be mounted at the two outer longitudinal sides 11 or at the incoming or outgoing conductor side, respectively. The spacing of the two legs 3 of the U-shaped sheet piece 2 has been selected sufficiently large, in order that for connecting the a and b conductors 7 of a telephone cable, three clamping pieces 9 and two contact elements 4 are enclosed between the two legs 3. The two legs 3 of the shield connecting element 1 are each pressed into a contact slot 5 of the contact elements 4 adjacent to the enclosed contact elements 4, and form an electrical contact connection between these contact elements 4 and the shield connecting element 1. The support ribs 8 engage behind the clamping pieces 9 on the inner side 24, whereas the support ribs 10 rest against the opposed outer side 23 or against the front side 11 of the clamping pieces 9. As the support ribs 8, 10 are displaced in height relative to each other, an excellent position with respect to tilting of the shield connecting element 1 is achieved. The shield cable 22 is supplied from outside and is connected to the shield connecting contact 19, for this purpose the two sheet-metal lugs 20 being bent toward each other and clamping fast, the shield 21 of the shield cable 22. The two a, b conductors 7 of the telephone cable are connected in a known manner to the contact elements 4 enclosed between the legs 3 by mean of a non-shown tool. By the shield connection, the two a and b conductors as well as the partially free-standing contact elements 4 are totally shielded by the shield connecting element 1. At the shield connecting element 1, plug connectors not shown in detail are mounted centrally in contact in a plug-in opening 25 of the connector bank 12. For this purpose, the plug connector contacts the shield 21 in the disconnect position 15 at the disconnecting contacts 26, which are connected with the shield connecting element 1 over the contact elements 4. The shield connecting elements 1 can in simple way be removed from the connector bank 12, for which purpose the shield connecting elements have simply to be pulled out opposite to the plug-in direction from the contact slots 5 of the insulation displacement contact elements 4.

In the second embodiment shown in FIGS. 5 to 8, the connector bank 12 is identical to the connector bank shown in the first embodiment of FIGS. 1 to 4. For connecting two shield cables 22, a double shield connecting element 1*a* is employed.

The double shield connecting element 1*a* comprises a rectangularly shaped sheet piece 2*a* with two side walls 3*a* and two narrow sides 17*a*.

The side walls 3*a* each comprise two support ribs 10 bent-off toward the inner side 16. At the lower edge 18 of the two narrow sides 17*a*, one shield connecting contact 19 each is provided for clamping fast the shield 21 of a shield cable 22. The shield connecting contact includes two sheet-metal lugs 20 bent-off in the same direction. At the double shield connecting element 1*a*, there can be connected two shield cables 22, the shields 21 of which are connected electrically and mechanically with the double shield connecting element by bending off the sheet-metal lugs 20.

Figure 5:
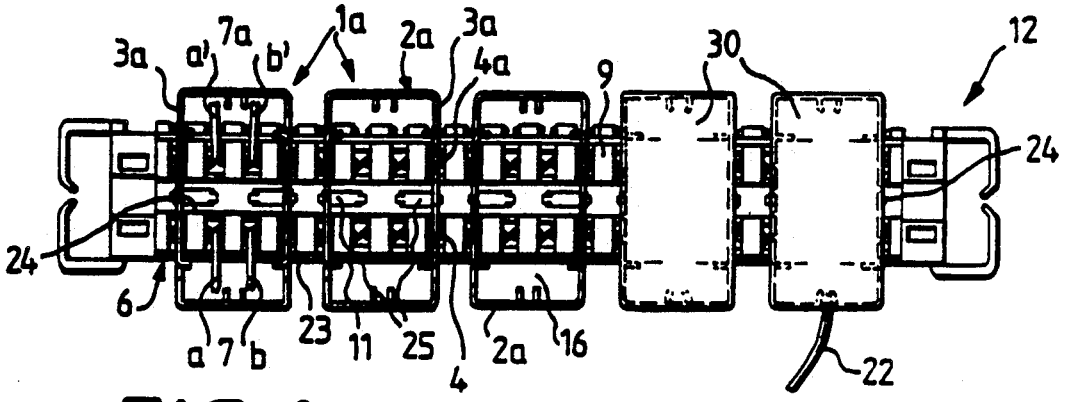
FIG. 5 is a top view of the connector bank with several shield connecting elements of a second embodiment of the invention.
Figure 6:
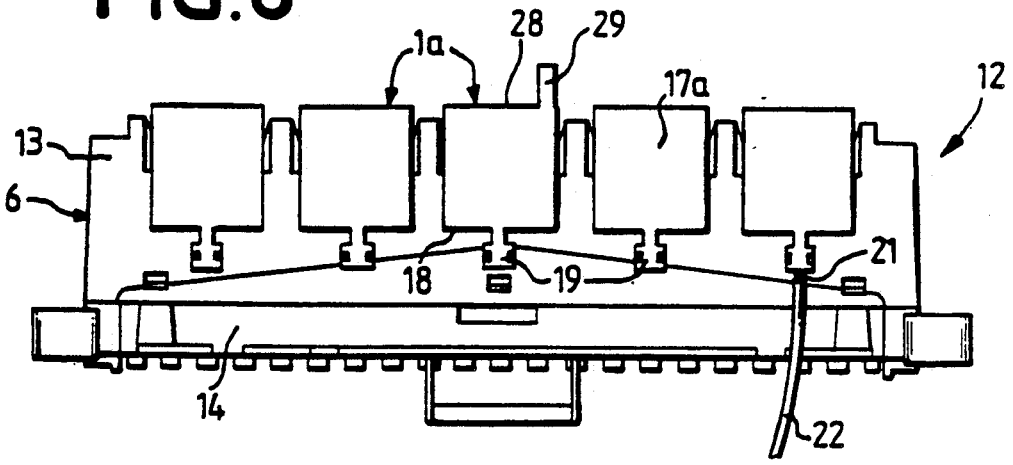
FIG. 6 is a side view of the connector bank according to FIG. 5.
Figure 7:
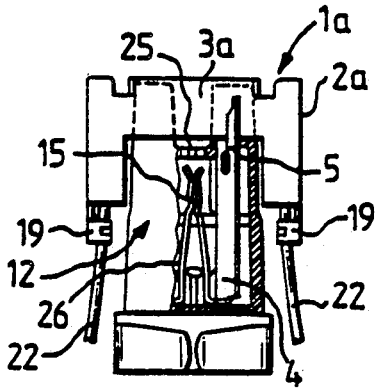
FIG. 7 is a cross-sectional view through the connector bank of FIG. 5.
Figure 8:
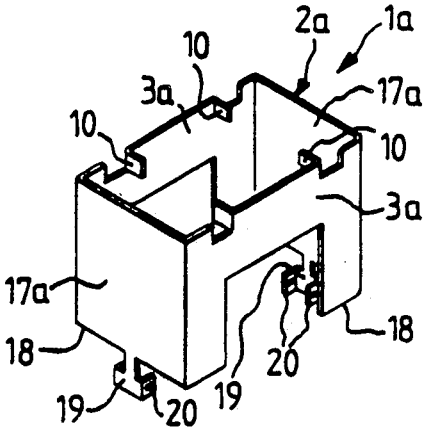
FIG. 8 is a perspective view of the shield connecting element according to FIG. 5.

The double shield connecting element 1*a* is mounted from above on the connector bank 12, as shown in FIGS. 5 to 7. On a 10-d.w. connector bank 10 there can be mounted five double shield connecting elements 1*a*. The double shield connecting elements 1*a* border two pairs of insulation displacement contacts 4, 4*a*, the two pairs being disposed within two lines of insulation displacement contacts. The spacing of the two side walls 3*a* of the sheetmetal piece 2*a* is so large that three clamping pieces 9 and two contact elements are enclosed between the two side walls 3*a*. The two side walls 3*a* of the shield connecting element 1*a* are each pressed into four contact slots 5 of the contact elements 4, 4*a* adjacent to the enclosed contact elements 4, 4*a*, and accomplish, thus, an electrical contact connection between these contact elements 4, 4*a* and the double shield connecting element 1*a*. The four support ribs 10 engage around the four clamping pieces 9 and fix the double shield connecting element 1*a* to the connector bank 12.

The double shield connecting element 1*a* serves for connecting two shield cables 22, which are connected to the shield connecting contact 19 by bending off the sheetmetal lugs 20.

Inside the double shield connecting element 1*a*, the a, b conductors 7 of the incoming side and the a', b' conductors 7*a* of the outgoing side are connected to the enclosed contact elements 4, 4*a* by means of a tool (not shown). Hereby, the conductors 7, 7*a* of the incoming and of the outgoing connection sides of the connector bank 12 are fully shielded by the double shield connecting element 1*a*.

While specific embodiments of the invention have been shown and described in detail to illustrate the application of the principles of the invention, it will be understood that the invention may be embodied otherwise without departing from such principles.

What is claimed:

1. A telecommunications and data systems connector bank for shielded cables including a shield cable, comprising:

a bank body supporting a plurality of cutting/clamping contacts, the bank body and the cutting/clamping contacts cooperating to form a plurality of contact slots; a shield connecting element comprising a sheet piece bent to form a U-shaped portion with legs insertable into ones of said contact slots and engagable with associated cutting/clamping contacts, said shield connecting element including a base portion with a shield connecting contact for connecting a shield cable, said plurality of contact slots being arranged with a spacing between adjacent contact slots, said legs being spaced a distance corresponding to at least twice the spacing of two adjacent contact slots.

2. A telecommunications and data systems connector bank according to claim 1, wherein said shield connecting element comprises two U-shaped portions forming a rectangularly bent double shield element, said double shield element including two sets of legs insertable into contact slots of two adjacent rows of cutting/clamping contacts, said double shield including a second base portion with a second base portion shield connecting contact for connecting a shield cable.

3. A telecommunications and data systems connector bank according to claim 1, wherein said legs include free ends comprising rear support ribs directed toward each other, said bank body including plural rows of clamping pieces adjacent said contact slots, said clamping pieces defining a bank body innerside and a bank body outerside, said ribs engaging behind said clamping piece on said bank body inner side.

4. A telecommunications and data systems connector bank according to claim 1, wherein said legs include inwardly bent support ribs, said bank body including plural rows of clamping pieces, said clamping pieces cooperating to define said contact slots, said bank body having an inner side at an inner end of said clamping pieces and an outer side at an outer end of said clamping pieces, said support ribs engaging said outer side of said clamping pieces.

5. A telecommunications and data systems connector bank according to claim 1, wherein said legs include a first set of inwardly bent support ribs, said bank body including plural rows of clamping pieces, said clamping pieces cooperating to define said contact slots, said bank body having an inner side at an inner end of said clamping pieces and an outer side at an outer end of said clamping pieces, said first set of support ribs engaging said outer side of said clamping pieces and a second set of support ribs engaging said bank body innerside, said first set of support ribs and said second set of support ribs being displaced in height relative to each other.

6. A telecommunications and data systems connector bank according to claim 2, wherein said legs include inwardly bent support ribs, said bank body including plural rows of clamping pieces, said clamping pieces cooperating to define said contact slots, said bank body having an inner side at an inner end of said clamping pieces and an outer side at an outer end of said clamping pieces, said support ribs engaging said outer side of said clamping pieces.

7. A telecommunications and data systems connector bank according to claim 2, wherein said legs include free ends comprising rear support ribs directed toward each other, said bank body including plural rows of clamping pieces adjacent said contact slots, said clamping pieces defining a bank body innerside and a bank body outerside, said ribs engaging behind said clamping piece on said bank body inner side.

8. A telecommunications and data systems and connector bank according to claim wherein said shield connecting element includes an upper edge with a contact tongue extending therefrom.

9. A telecommunications and data systems connector bank according to claim 1, wherein said shield connecting element includes an upper closing cover.

10. A connector bank according to claim 1, wherein said shield connecting contact is provided at a lower edge at said base portion and includes two bent-off lugs.

11. A telecommunications and data systems connector bank for shielded cables including a shield cable, comprising:

a double shield connecting element formed of a rectangularly bent sheet piece defining side walls, each side wall having first and second leg portions, said leg portions being insertable into contact slots of two cutting/clamping contacts for two adjacent cutting/clamping contact rows, the double shield connecting element including first and second base portions each including a shield connecting contact for connecting a shield cable, said side walls being spaced a distance corresponding to at least twice the spacing of two adjacent contact slots.

* * * * *